US006409477B1

(12) United States Patent
Blecker et al.

(10) Patent No.: US 6,409,477 B1
(45) Date of Patent: Jun. 25, 2002

(54) VACUUM PUMP

(75) Inventors: Armin Blecker, Asslar; Wolfgang Eberl, Solms; Heinrich Lotz, Wetzlar; Heinz Reichhart, Asslar-Berghausen, all of (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/609,978

(22) Filed: Jul. 5, 2000

(30) Foreign Application Priority Data

Jul. 5, 1999 (DE) ..... 199 30 952

(51) Int. Cl.[7] ..... F04B 23/08; F04B 23/14; F04B 17/00; F04B 3/00

(52) U.S. Cl. ..... 417/199.1; 417/201; 417/203; 417/248; 417/423.4

(58) Field of Search ..... 417/199.1, 201, 417/203, 423.4, 248

(56) References Cited

U.S. PATENT DOCUMENTS 3,536,418 A * 10/1970 Breaux ..... 417/49
3,668,393 A * 6/1972 Von Rauch ..... 250/49.5 A
3,969,039 A * 7/1976 Shoulders ..... 417/244
4,919,599 A * 4/1990 Reich et al. ..... 417/423.4
5,092,740 A * 3/1992 Yamamura ..... 417/201
5,118,251 A * 6/1992 Saulgeot ..... 415/90
5,445,502 A * 8/1995 Itou et al. ..... 417/203
5,893,702 A * 4/1999 Conrad et al. ..... 415/71

* cited by examiner

*Primary Examiner*—Charles G. Freay
*Assistant Examiner*—Timothy P. Solak
(74) *Attorney, Agent, or Firm*—Sidley Austin Brown & Wood, LLP

(57) ABSTRACT

A vacuum pump including suction and discharge regions, two gas friction pumps arranged on opposite side of the suction region and parallel to each other and each having at least one stage and a discharge region channels connecting the discharge regions and providing for gas flow from the discharge regions into a common discharge region of the two gas friction pumps, and a multi-stage pump located downstream of both gas friction pumps for compressing the gas flowing through the multi-state pump and having a suction region and a discharge region connected with the discharge region of the vacuum pump, with gas flowing into the suction region from the common discharge region of the two gas friction pumps.

6 Claims, 1 Drawing Sheet

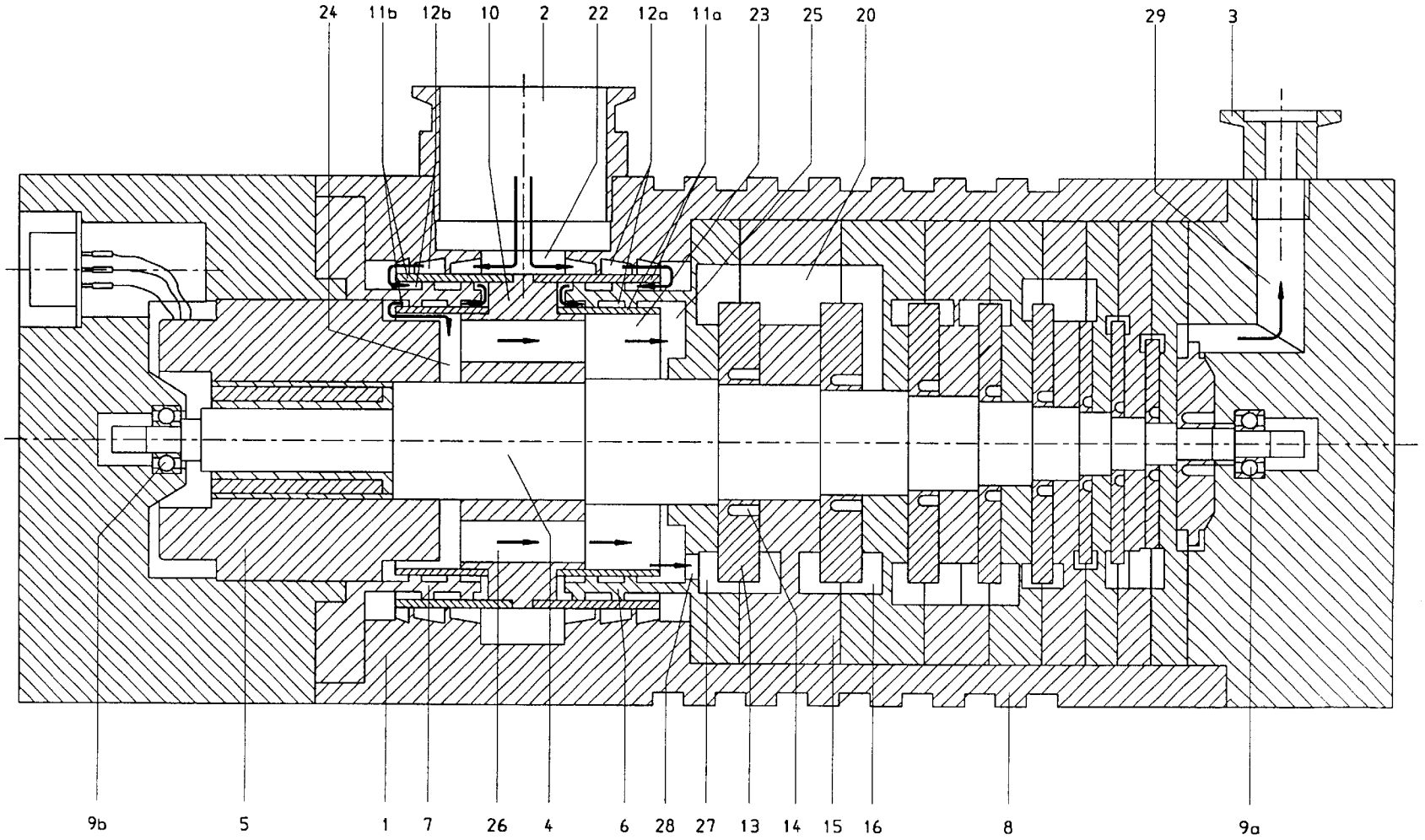
3
29
20
25
23
11a
12a
22
2
10
12b
11b
24
9a
8
16
15
14
13
27
28
6
4
26
7
1
5
9b

VACUUM PUMP

BACKGROUND OF THE INVENTION

1. Field of the Invention

The present invention relates to a vacuum pump including two one- or two-stage gas friction pumps and a multistage pump arranged downstream of the two gas friction pumps.

2. Description of the Prior Art

For producing a high vacuum, combination of different types of vacuum pumps are necessary. This is because the pressure region, which is further away from the atmospheric pressure and closer to a pressure of about $10^4$ mbar and lower, has several flow regions in which physical characteristics of the conditions and streams of gasses are subjected to different physical laws.

Thus, for producing a high vacuum, at least two different vacuum pumps having different operational characteristics are combined. For example, a pump stand can include a turbomolecular pump, and a vane rotary pump dischargeable into atmosphere. Pump stands, which consist of at least two vacuum pumps necessary to achieve the required vacuum-technical parameters such as pressure ratios and suction speeds, have serious drawback. These drawbacks consist in that they are expensive and require a relatively large mounting space. Each pump requires its own drive with a power supply, independent monitoring and control, and its own bearing system. The connections between the two pumps, with appropriate valves, and separate control units increase the costs of such pump stands.

Accordingly, an object of the present invention is to provide a single vacuum pump capable of operating in the entire pressure range from the atmospheric pressure to pressure of $1^4$ mbar and lower.

Another object of the present invention is to provide a vacuum pump formed as single compact apparatus so that the drawbacks of multi-pump stands are eliminated.

A further object of the present invention is to provide a vacuum pump having adequately high pressure ratio and suction speed capable of meeting the requirements of the fields of their application.

A still further object of the present invention is to provide a vacuum pump reliable in operation.

A yet another object of the present invention is to provide a vacuum pump with a lubrication-free operation at the high-vacuum side.

SUMMARY OF THE INVENTION

These and other objects of the present invention, which will become apparent herein after are achieved by providing a vacuum pump including suction and discharge regions and two gas friction pumps arranged on opposite sides of the suction region and parallel to each other in a gas flow direction from the suction region to the discharge region. Each of the gas friction pumps has at least one stage and a discharge region. The pump further includes channels connecting the discharge regions of the two gas friction pumps and providing for gas flow from the discharge regions of the two gas friction pumps into a common discharge region of the two gas friction pumps. A multi-stage pump is located downstream of both gas friction pumps for compressing the gas flowing through the multi-stage pump.

The multi-stage pump has a suction region and a discharge region connected with the discharge region of the vacuum pump, and a conduit for connecting the common discharge region of the two gas friction pumps with the suction region of the downstream multi-stage pump.

The present invention provides a compact vacuum pump covering the entire pressure region from the atmospheric pressure to the high vacuum pressure. The parallel arrangement of gas friction pumps at the high-vacuum side provides for a double-flow suction region whereby a high suction speed becomes possible. The aspirated gas is adequately compressed within the gas friction pumps so that the subsequent pump can be formed as a single-flow pump.

This combination, together with the feature that the two gas streams are combined within the gas friction pump unit and enter the following suction chamber of the multi-stage pump as a single stream, insures a compact constructions with reduced dimensions which noticeably reduce the manufacturing and mounting costs. A stable support is provided by arranging the shaft bearings on both sides of the rotor, which also permits to use bearing having a smaller diameter. Such bearings provide for operation without problem and high rotational speeds. In addition, the bearings are separated from the high vacuum side by the gas friction pumps, whereby a lubrication-free environment is created at the high-vacuum side.

For constructive and operational reasons, it is advantageous to form the gas friction pumps as Holweck pumps. Those are particularly suitable as they can be fitted in a narrow space and permit to achieve a maximal pressure ratio. The double-flow arrangement permits to achieve a required suction speed.

As a subsequent pump, advantageously, a peripheral pump can be used. Such a pump is particular suitable for compression of the gas discharged by the two gas friction pumps.

A big advantage is achieved when the stator elements of the peripheral pump are formed as discs abutting each other. In conventional designs, in which the stator discs are separated by rotor discs, a returned flow through the clearances between the discs can take place, which increase losses and substantially reduces the pressure ratio. The above-discussed drawback of the conventional peripheral pumps is eliminated by arranging, according to the present invention, the stator elements, the stator discs, in abutting relationship with each other, which is only then possible when, according to the present invention, the rotor elements are secured on the rotor shaft with camp rings. Only under these conditions, the rotor elements can be arranged one after another with an optimal axial backlash.

The novel features of the present invention, which are considered as characteristic for the invention, are set forth in the appended claims. The invention itself, however, both as to its construction and its mode of operation, together with additional advantages and objects thereof, will be best understood form the following detailed description of preferred embodiment, when read with reference to the accompanying drawings.

BRIEF DESCRIPTION OF THE DRAWINGS

Single FIGURE: show a cross-sectional view of a high-vacuum pump according to the present invention.

DETAILED DESCRIPTION OF THE PREFERRED EMBODIMENT

A vacuum pump according to the present invention, which is shown in the drawing, includes a pump housing 1 having a suction flange 2 and a discharge flange 3, with both parallel stages of the gas friction pump, which are formed as Holweck pumps 6,7, and a peripheral or vortex pump 8 being arranged in the housing 1. The rotor elements 10, 11*a*, 11*b*, and 13 of both gas friction pumps and the peripheral pump are supported on a common shaft 4. The common shaft 4 itself is supported in opposite bearings 9*a*, 9*b*. One of the bearings, the bearing 9*a* is located in the region of the atmosphere pressure, and the other bearing, the bearing 9*b*, is located in the region of the vacuum pressure. The drive 5 is likewise located in the region of the vacuum pressure. The rotor elements of the double-flow Holweck pumps consist of support rings 10 on which cylindrical components 11*a* and 11*b* of both parallel pumps are supported. Stator elements 12*a*, 12*b*, which are formed as spiral flutes and are enveloped by respective cylindrical rotor elements 11*a*, 11*b*, form, together with the rotor elements 11*a*, 11*b*, two two-stage Holweck pumps.

The peripheral pump 8 is formed of a plurality of rotor discs 13 which are secured on the common shaft 4 with clamp ring 14. Stator components 15, having a delivery channel 16, are arranged between the rotor discs 13.

The gas delivery take place as shown in the drawings by arrows. The gas from the suction region 22 is delivered to the discharge regions 23, 24 via the parallel pumping Holweck pumps 6 and 7 which are formed of two, serially connected pumping stages 11*a*/12*a* and 11*b*/12*b*. The connection channels 26 between the discharge regions 23 and 24 provide for gas flow into the discharge chamber 25 of the gas friction pump formed of Holweck stages. From the discharge chamber 25, the gas flow through the connection space 28 into the suction region 27 of the peripheral pump 8. In this region, the gas is compressed in a plurality of pump stages, which are connected by channels 20, to an atmospheric pressure and is delivered into the discharge chamber 29 which is connected with the discharge flange 3.

Though the present invention was shown and described with references to the preferred embodiments, such are embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined b the appended claims.

What is claimed is:

1. A vacuum pump, comprising a suction region; a discharge region; two gas friction pumps arranged on opposite side of the suction region and parallel to each other in a gas flow direction from the suction region to the discharge region, each of the gas friction pumps having at least one stage and a discharge region; channel means connecting the discharge regions of the two gas friction pumps and providing for gas flow from the discharge regions of the two gas friction pumps into a common discharge region of the two gas friction pumps; a multi-stage pump located downstream of both friction pumps for compressing the gas flowing through the multi-stage pump and having a suction region and a discharge region connected with the discharge region of the vacuum pump; and conduit means for connecting the common discharge region of the gas friction pumps with the suction region of the downstream multi-stage pump.

2. A vacuum pump as set forth in claim 1, wherein each of the two stages of the gas friction pump is formed as a Holweck pump.

3. A vacuum pump as set forth in claim 1, wherein the channel means is formed as axial bores formed inside the gas friction pump.

4. A vacuum pump as set forth in claim 1, wherein the downstream, multi-stage pump is formed as a peripheral pump.

5. A vacuum pump as set forth in claim 4, wherein the stator of the peripheral pump is formed of a plurality of stator discs abutting each other.

6. A vacuum pump as set forth in claim 5, wherein the peripheral pump as a plurality of rotor elements secured on a common shaft with clamp rings.

* * * * *